US006385992B1

(12) United States Patent
Flore, Jr.

(10) Patent No.: US 6,385,992 B1
(45) Date of Patent: May 14, 2002

(54) BEVERAGE BOTTLE CONTAINER

(76) Inventor: Joseph Frank Flore, Jr., 711 Aspen La., Lebanon, PA (US) 17042

( * ) Notice: Subject to any disclaimer, the term of this patent is extended or adjusted under 35 U.S.C. 154(b) by 0 days.

(21) Appl. No.: 09/642,409

(22) Filed: Aug. 21, 2000

(51) Int. Cl.[7] ..... F25D 3/08
(52) U.S. Cl. ..... 62/457.9; 62/457.4; 62/536
(58) Field of Search ..... 62/457.4, 536, 62/457.9

(56) References Cited

U.S. PATENT DOCUMENTS 3,998,072 A * 12/1976 Shaw ..... 62/457
4,281,520 A * 8/1981 Norwood ..... 62/372
4,338,795 A * 7/1982 House, Jr. ..... 62/372
4,413,481 A * 11/1983 Thomas ..... 62/371
4,580,412 A * 4/1986 Wells ..... 62/372
4,628,705 A * 12/1986 Nave ..... 62/457
4,961,324 A * 10/1990 Allan ..... 62/400
5,188,877 A * 2/1993 Magaro ..... 428/80
5,313,807 A * 5/1994 Owen ..... 62/457.3
5,325,988 A * 7/1994 Ekern ..... 220/411
5,406,808 A * 4/1995 Babb et al. ..... 62/457.4
5,555,746 A * 9/1996 Thompson ..... 62/457.4

* cited by examiner

*Primary Examiner*—William Doerrler
*Assistant Examiner*—Mark Shulman
(74) *Attorney, Agent, or Firm*—Fay, Sharpe, Fagan, Minnich & McKee, LLP

(57) ABSTRACT

A rigid lightweight portable Beverage Bottle Container is described. It features a two-piece double walled construction, which provides impact, shock protection, and a thermal retention barrier and or coolant for beverage bottles, and features a carry handle.

7 Claims, 8 Drawing Sheets

BEVERAGE BOTTLE CONTAINER

FIELD OF THE INVENTION

This invention is directed to rigid containers; for protecting bottles contained therein from impact damage; to containers for retaining the temperatures of beverage bottles contained therein; to containers for transporting beverage bottles of various materials.

1. Description of the Prior Art

Prior art beverage bottle containers consist of soft insulated fabrics which offer limited impact and thermal insulating characteristics.

2. Background of the Invention

With the emergence of a wide variety of refreshment beverages and an increasingly active society, a need for a rigid, convenient, portable, container to protect, thermally insulate, and to increase the portability of a single beverage bottle is needed. Single bottles are often transported to sporting events, to outdoor events and to and from indoor activities. Frequently these beverage bottles are of glass or thin walled plastic and have little or no impact resistance. The nature of the beverages therein these bottle require temperate maintenance for optimum taste and refreshment. The desire to carry these beverage bottles to various activities demand increased portability. There is a need for a container, which adequately maintains the temperature of beverage bottles. There is a need for a container, which serves to support and protect beverage bottles. There is a need for a container to enhance the portability of a beverage bottle. The present invention recognizes, addresses, and satisfies these needs.

SUMMARY OF THE INVENTION

The present invention discloses a rigid container for carrying, protecting, and insulating of a beverage bottle. The container has one recess therein for the containment of a beverage bottle. The recess therein will hold a variety of sizes and shaped bottles. A container according to the present invention has a hinged case including two similar halves hinged together for closing and opening. A container according to the present invention has a method of securing the container closed opposite the hinges. In another embodiment a carry strap is utilized to secure the container closed opposite the hinges. The halves having double walls provide a space for various forms of thermal insulation and coolant. The rigid halves also provide impact protection to the contained bottle. In another embodiment, a sealing edge, a gasket, or a seal in a groove can be provided around the container or around a portion of it to further insulate the contained bottle and to seal the interior of the container against the neck of various sized bottles.

DETAILED DESCRIPTION OF THE PREFERRED EMBODIMENT

Figure 1:
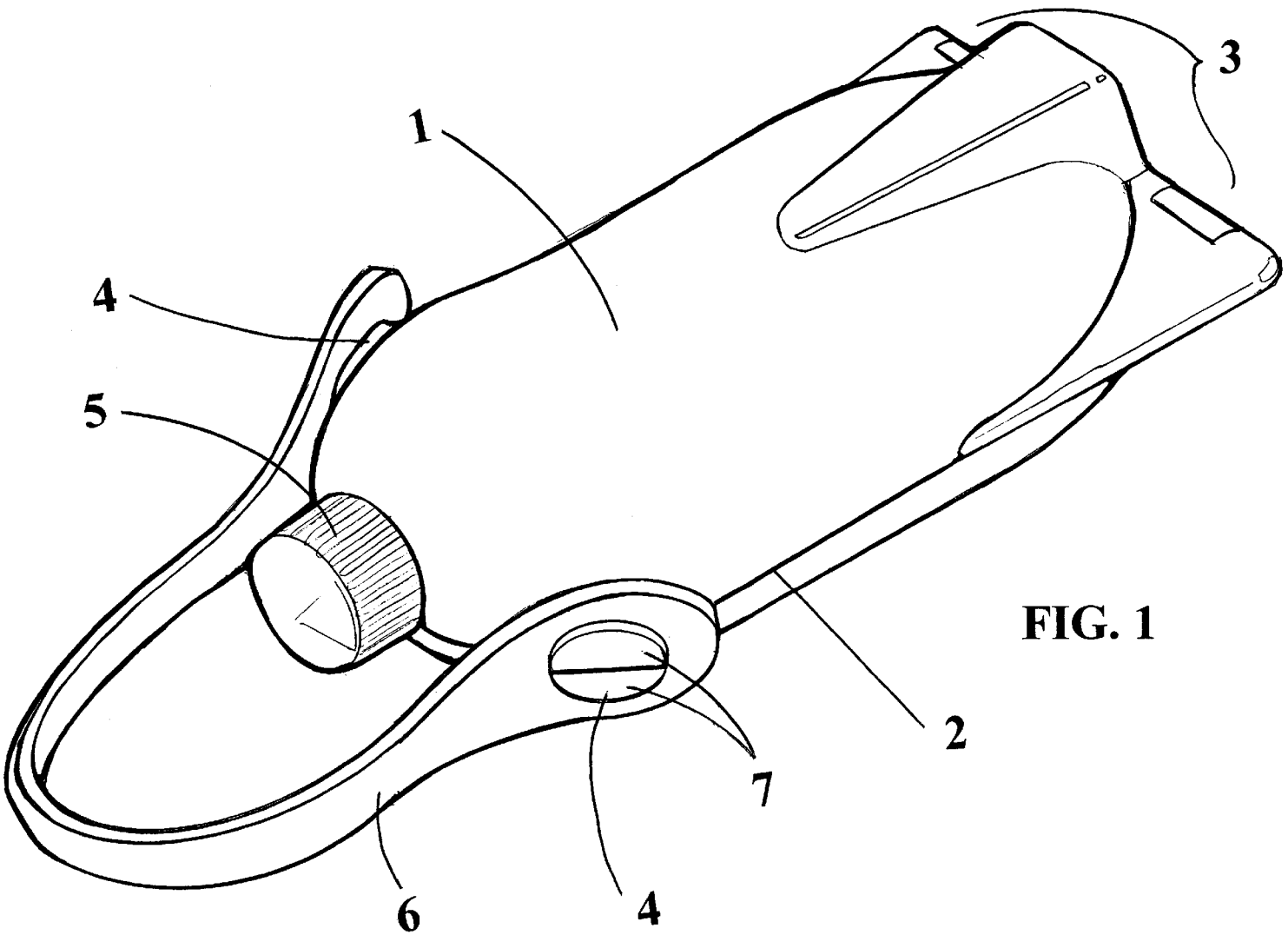
FIG. 1 is a perspective view of the present invention with a bottle therein with carry strap attached.
Figure 2:
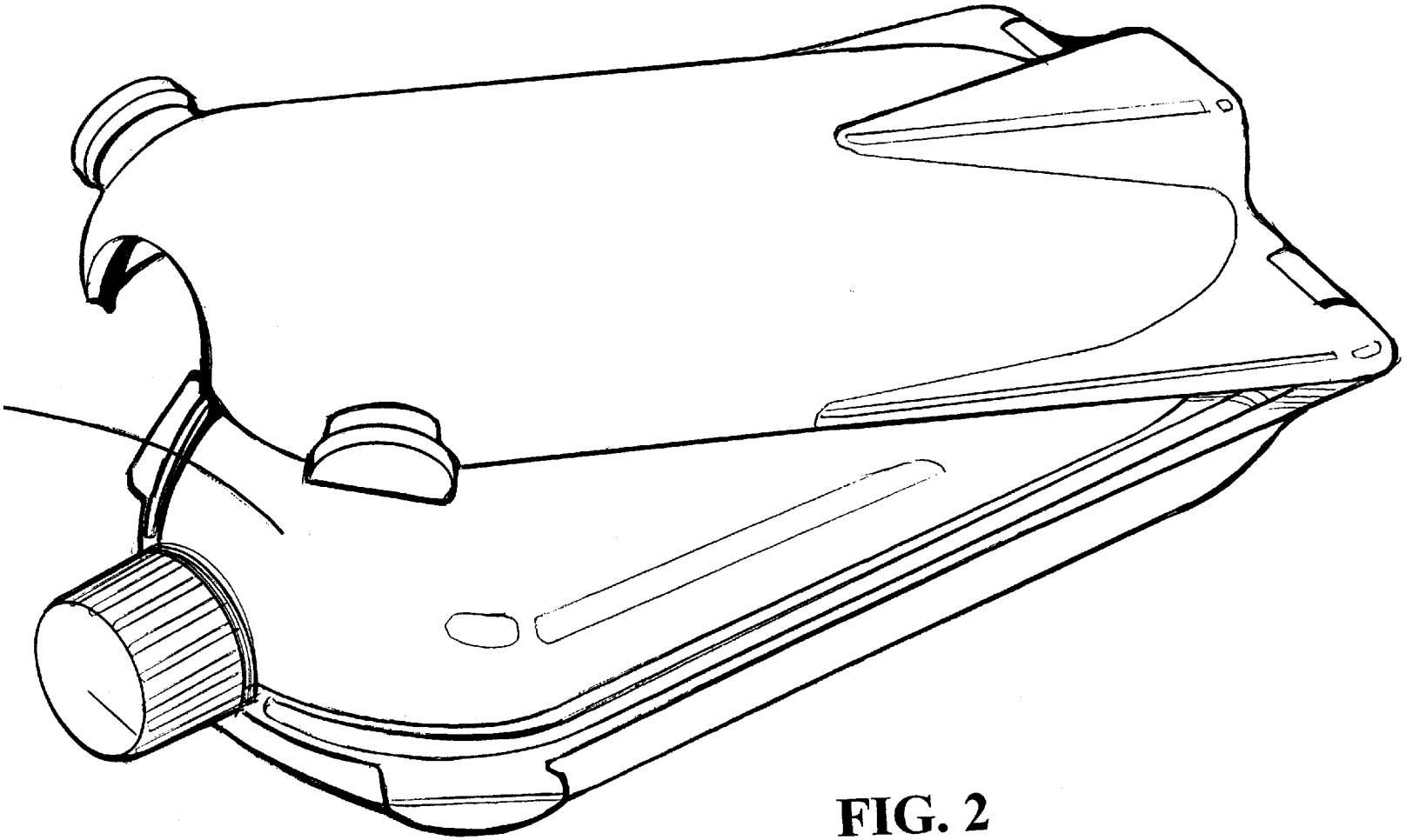
FIG. 2 is a perspective view of the invention partially opened with a bottle therein without carry strap.
Figure 3:
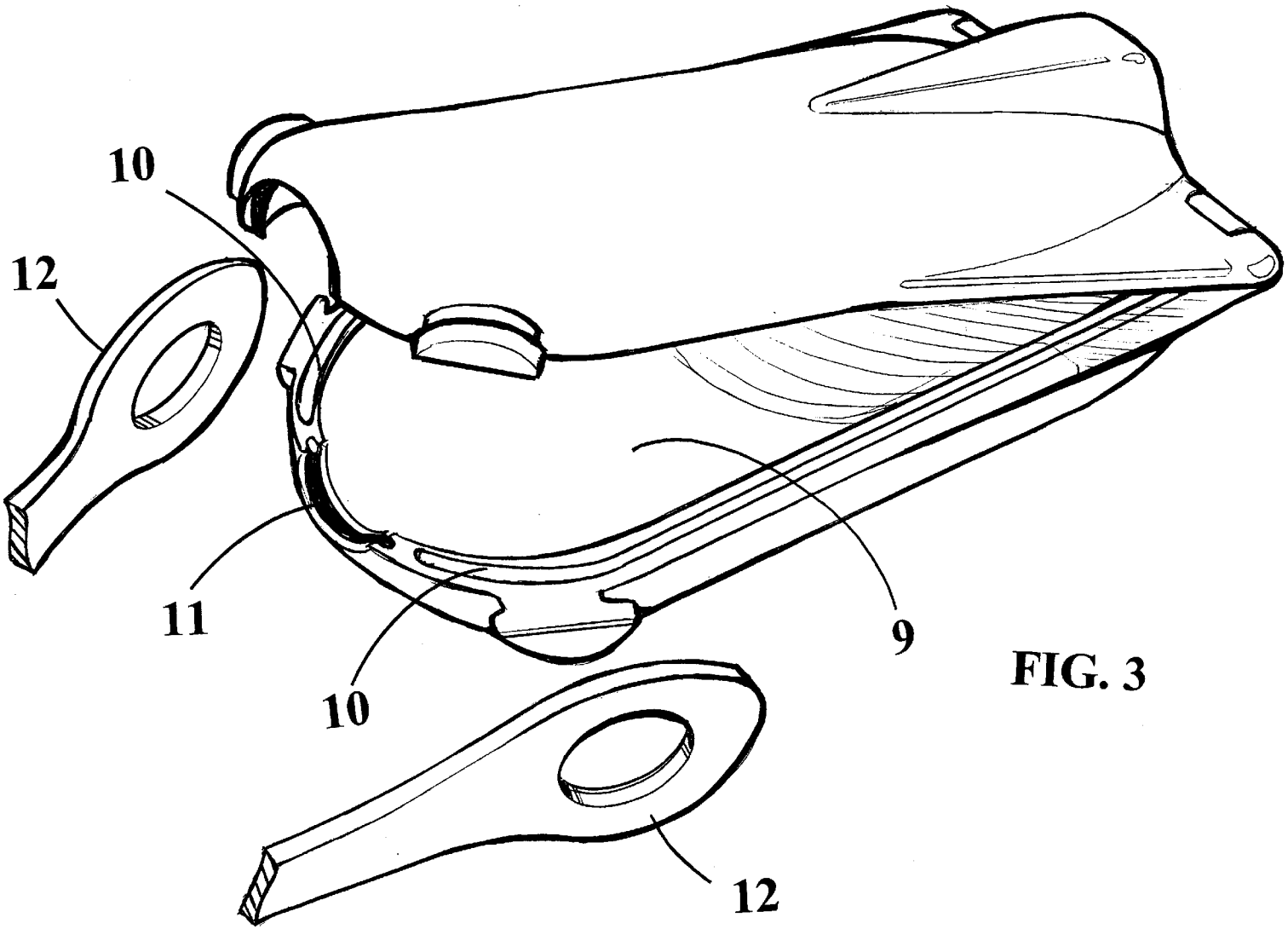
FIG. 3 is a perspective view of the invention partially opened showing the bottle compartment and the detached carry strap.

The present invention is directed towards a rigid container for carrying, protecting, and insulating a beverage bottle.

Referring to FIGS. 1–4, the beverage bottle container 1 includes a pair of rigid, double-walled container halves which join along a centerline 2. The two halves are hinged adjacent a bottom surface 3 and latched at the opposing end 4, creating an insulated cavity in which a single beverage bottle of various sizes and shapes can be held. A top end 5 of the beverage bottle extends beyond the container to allow access to the beverage therein while the beverage bottle remains encapsulated by the double walled container. One embodiment of the invention includes a detachable carry strap 6 which also serves as a means to latch or secure the halves of the double walled container's strap posts 7 closed opposite its hinges.

The bottle container opens along its hinges to access a beverage bottle recess 9. A tongue and groove sealing edge, a gasket, or a seal in a groove 10 are provided around the container or a portion thereof to further insulate the contained bottle and to seal the interior of the container. Further sealing means are provided around the neck opening 11 of the container. More particularly, the bottom surface 3 is hinged with a pair of molded-in hinges and corresponding mating slots.

Figure 4:
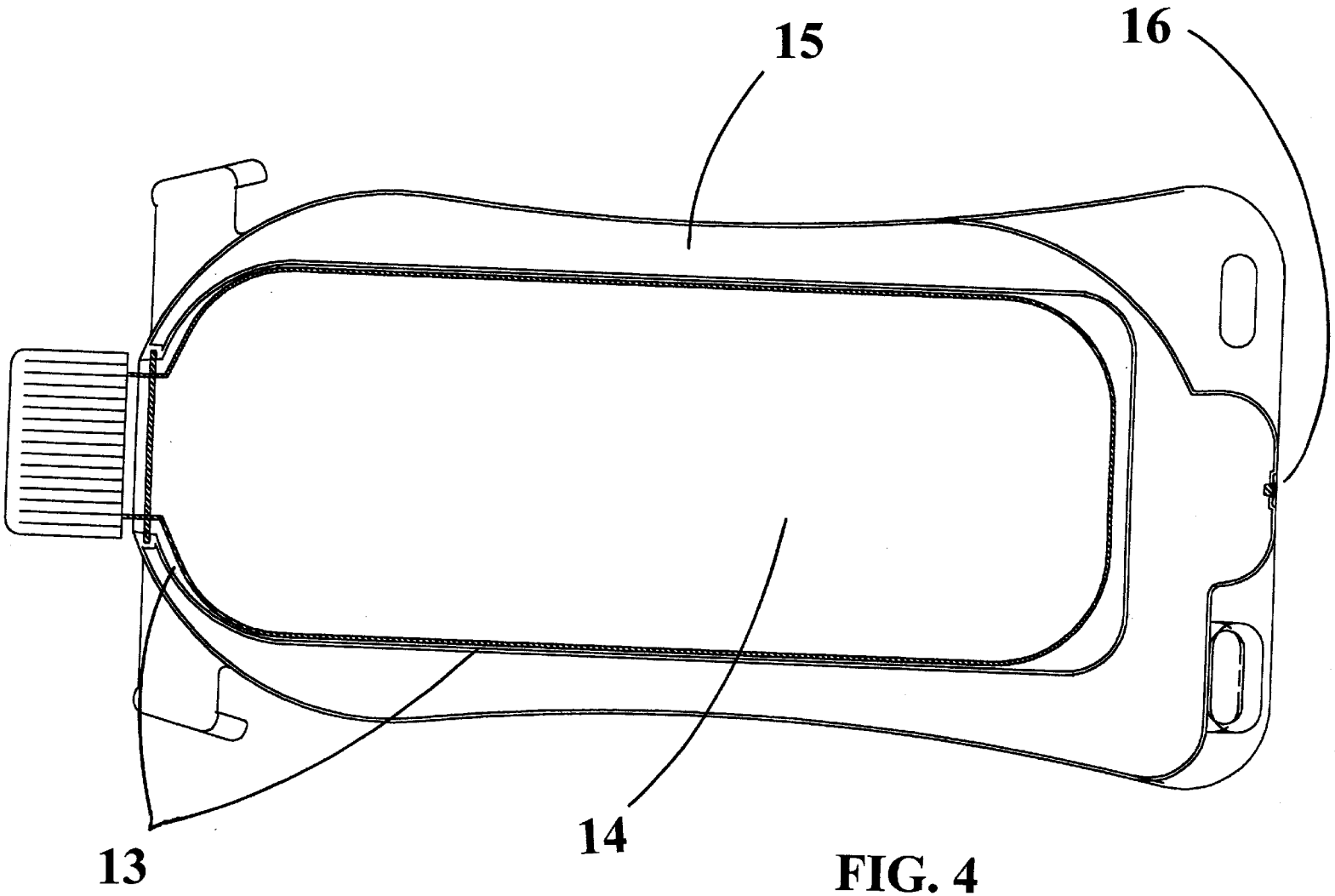
FIG. 4 is a opened side section view of the present invention with a bottle therein.
Figure 5:
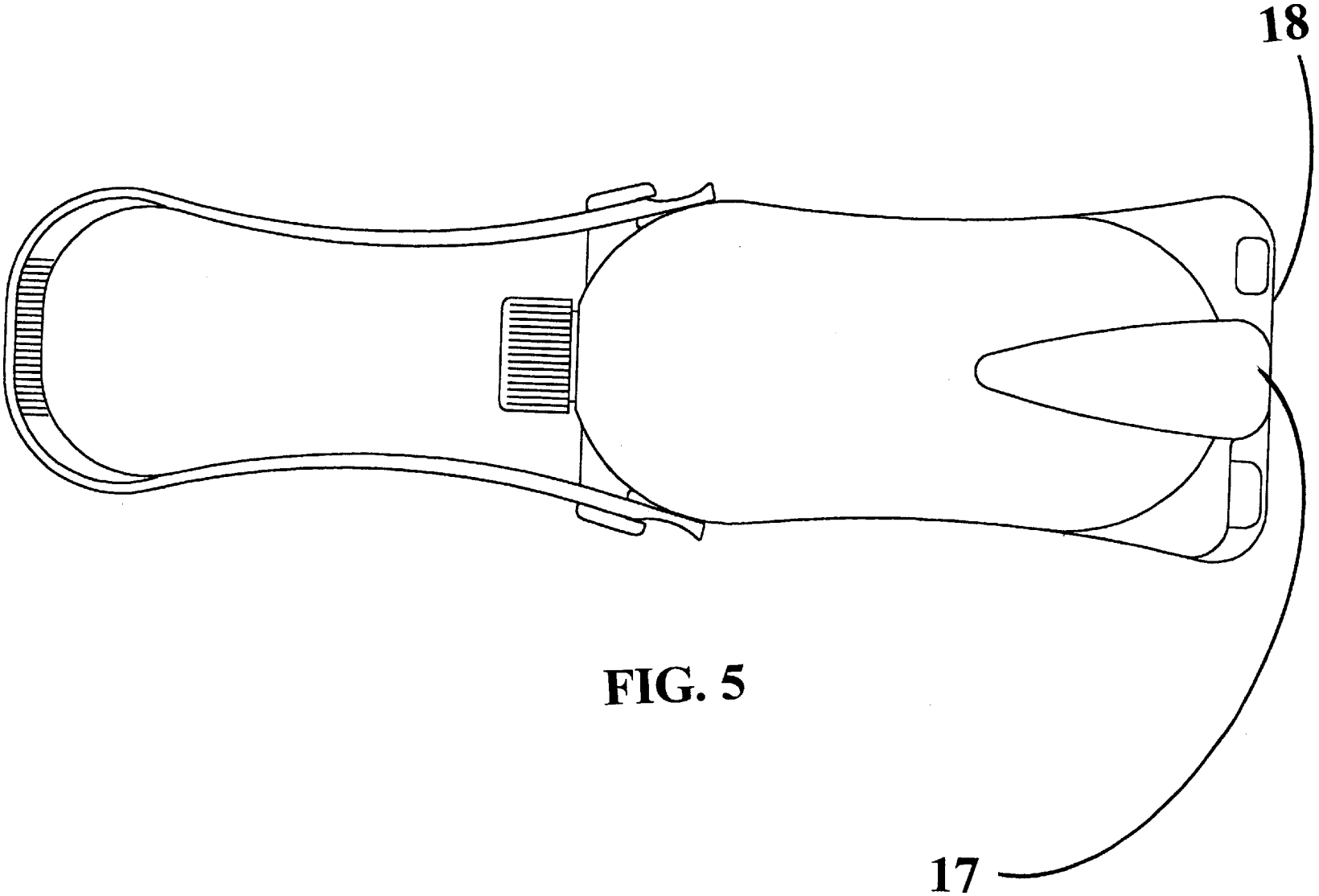
FIG. 5 is a schematic view of the present invention of the front with carry strap attached and bottle therein.
Figure 6:
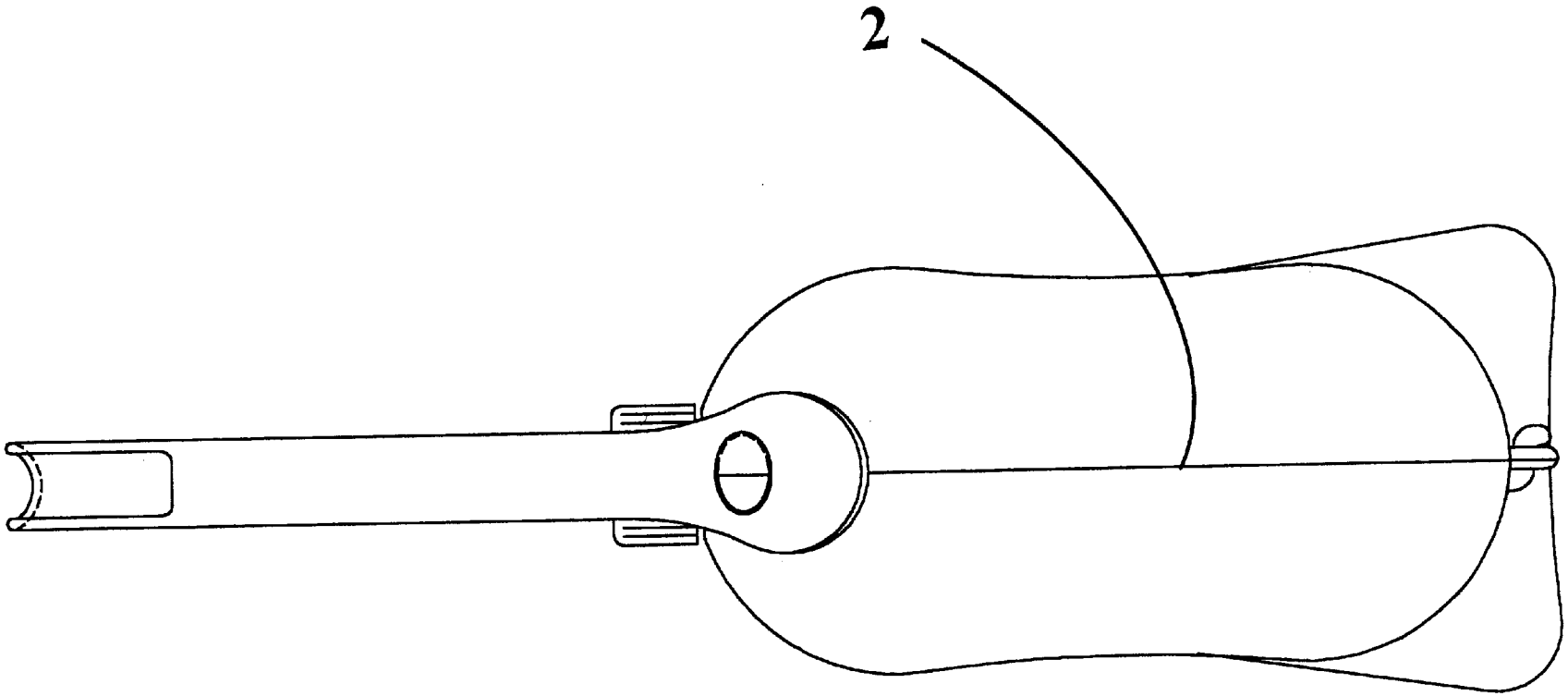
FIG. 6 is a schematic view of the present invention of the side with carry strap attached and bottle therein.
Figure 7:
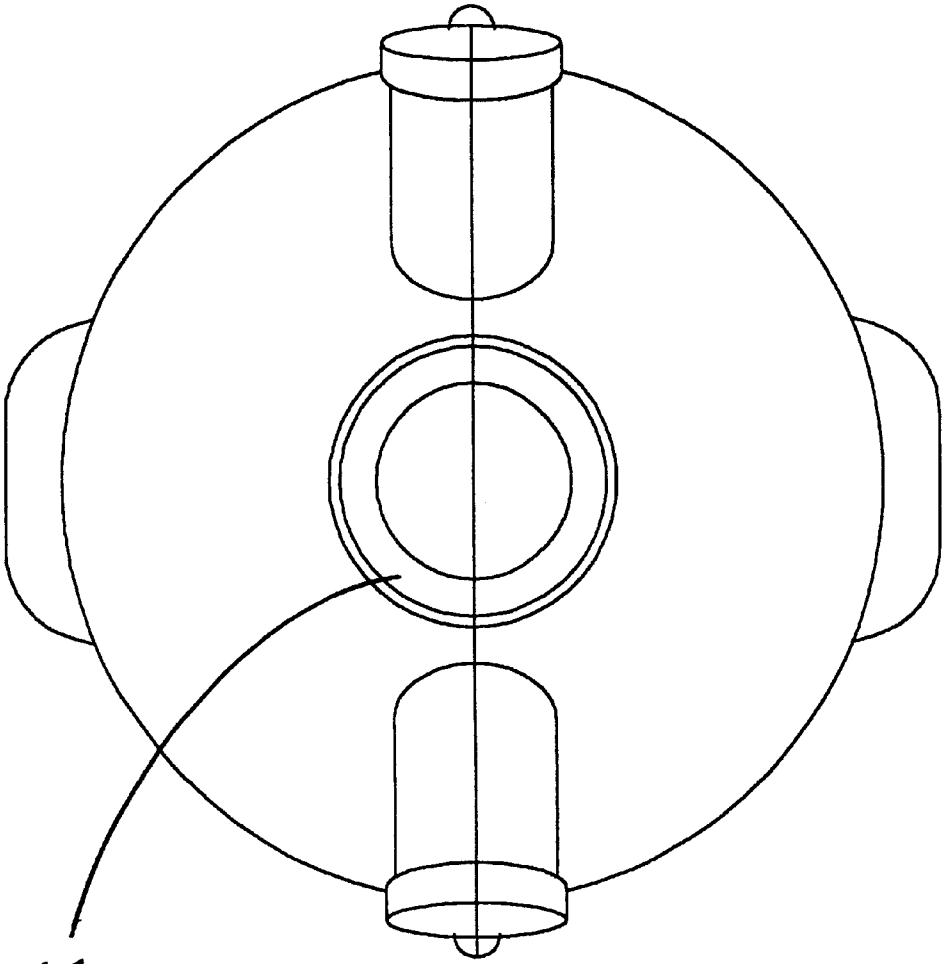
FIG. 7 is a schematic view of the top of the present invention without carry strap.
Figure 8:
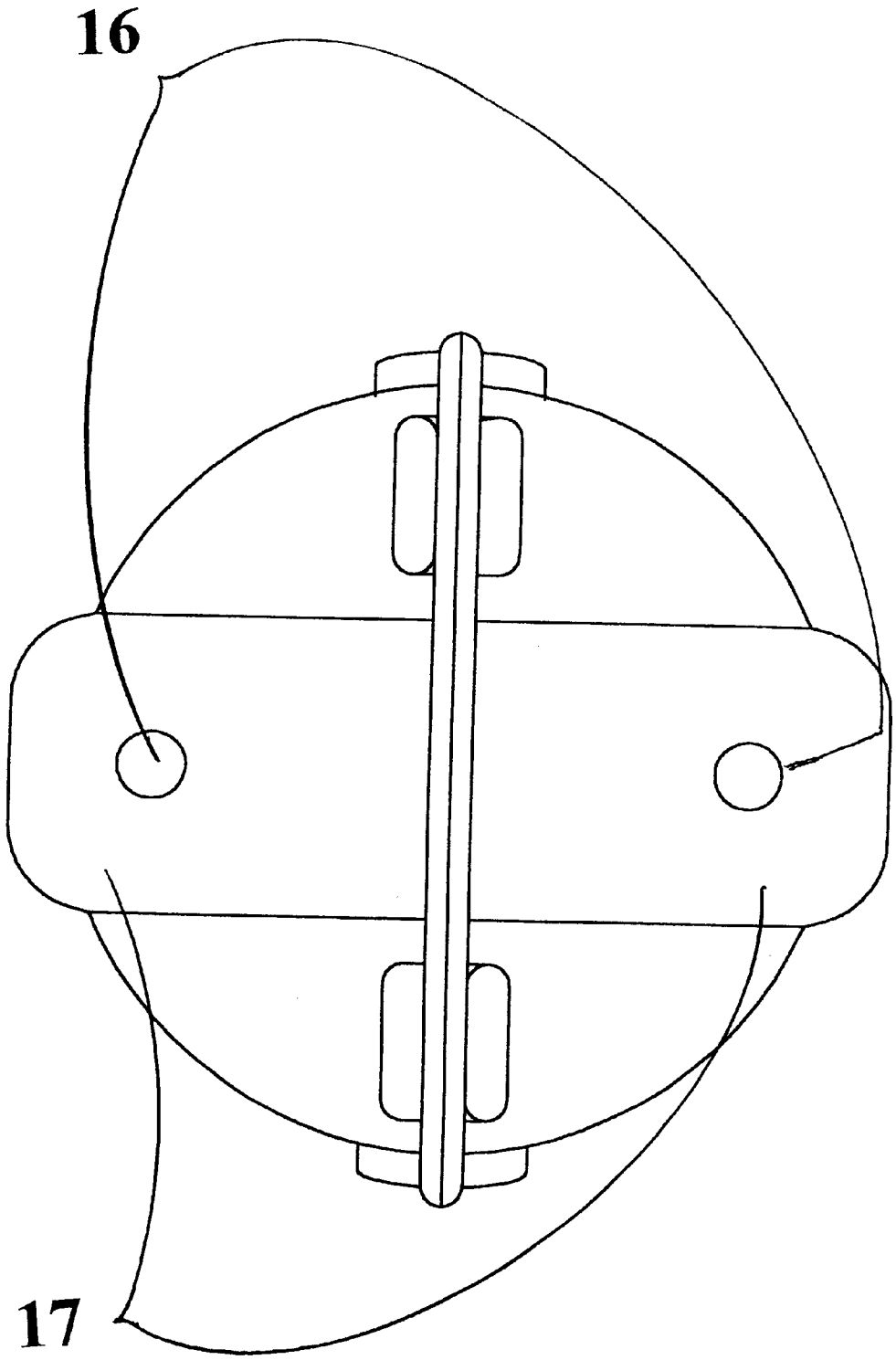
FIG. 8 is a schematic view of the bottom of the present invention showing capped entrance to hollow between double walls.

The bottle recess 9 is adapted to receive a single beverage bottle 14 of varying size and shape. The double-walled halves provide a space for various forms of thermal insulation and coolant 15. A plug or cap 16 seals off the opening in each container half, as shown in FIGS. 4 and 8.

Referring to FIGS. 5–8, the bottom surface includes a pair of support feet 17 which are perpendicular to a bottom support ridge 18 enabling the container to stand upright along its short dimension.

What is claimed is:

1. A beverage bottle container comprising:

a pair of rigid, double-walled mating container halves having substantially semi-cylindrical inner surfaces about a longitudinal axis for engagement with a beverage bottle;

each of said container halves including:

a bottom surface having (i) a bottom support ridge extending along a first direction perpendicular to the longitudinal axis, and (ii) a bottom foot support extending along a second direction perpendicular to the first direction;

at least one of a molded-in hinge and a mating slot disposed above and adjacent to the bottom surface; and a top surface having (i) a neck opening through which a neck of the beverage bottle protrudes, and (ii) a pair of strap posts disposed below the neck opening, said strap posts extending along the first direction perpendicular to the longitudinal axis; and a carrying handle operatively connected to strap posts for holding the container halves in a closed position.

2. The beverage container according to claim 1, wherein the container halves include a cooperative sealing means for sealing the substantially semi-cylindrical inner surfaces, thereby creating a substantially cylindrical insulated chamber.

3. The beverage container according to claim 2, wherein the cooperative sealing means include:

a seal around a perimeter of the neck opening; and a seal around a perimeter of the semi-cylindrical inner surfaces.

4. The beverage container according to claim 3, further including:

an insulating material disposed between the double walls of the container halves.

5. The beverage bottle container according to claim 3, further including:

a freezable coolant disposed between the double walls of the container halves.

6. The beverage container according to claim 3, wherein the double walls of the container halves are made of polyethylene.

7. A bottle carrier comprising:

a pair of double-walled mating halves joined to form a substantially cylindrical, insulated inner chamber;

a support base extending from the bottom of the inner chamber having a pair of perpendicularly crossed support members for supporting the carrier in an upright position;

a pair of hinges and receiving slots molded into one of the bottom support members; and a latching assembly including a pair of support posts extending from a top portion of the outer surface, said support posts being operatively connected to ends of a carry handle.

* * * * *